United States Patent [19]

Cormier et al.

[11] 3,967,464

[45] July 6, 1976

[54] AIR SEPARATION PROCESS AND SYSTEM UTILIZING PRESSURE-SWING DRIERS

[75] Inventors: Thomas E. Cormier, Allentown; William J. McAuley, Coopersburg, both of Pa.

[73] Assignee: Air Products and Chemicals, Inc., Allentown, Pa.

[22] Filed: July 22, 1974

[21] Appl. No.: 490,639

[52] U.S. Cl. ..... 62/13; 55/62; 62/39; 62/18

[51] Int. Cl.[2] ..... F25J 3/02

[58] Field of Search ..... 62/13, 17, 18, 24, 31, 62/9–11, 12, 23, 27–29, 32, 36, 42; 55/59, 62

[56] References Cited

UNITED STATES PATENTS

| | | | |
|---|---|---|---|
| 3,210,950 | 10/1965 | Lady | 62/13 |
| 3,564,816 | 2/1971 | Batta | 55/62 |

*Primary Examiner*—Frank W. Lutter
*Assistant Examiner*—Frank Sever
*Attorney, Agent, or Firm*—Ronald B. Sherer; Barry Moyerman

[57] ABSTRACT

A cryogenic air separation system is described in which pressure-swing adsorption driers are used to remove virtually all of the moisture from the feed air prior to the passage of the feed air stream through reversing heat exchangers which remove the carbon dioxide. The reversing heat exchangers are regenerated by at least one outgoing product nitrogen stream, while the adsorption driers are regenerated by all or a portion of a low pressure stream withdrawn from the low pressure column the composition of which may be rich in either nitrogen or oxygen depending upon whether the volume of product nitrogen or oxygen is to be maximized. A portion of this low pressure stream may be recovered as a dry product stream, while an additional stream of high purity product oxygen may also be recovered.

12 Claims, 2 Drawing Figures

AIR SEPARATION PROCESS AND SYSTEM UTILIZING PRESSURE-SWING DRIERS

BACKGROUND OF THE INVENTION

It is well known that the need for nitrogen for inert atmospheres in the metallurgical and other industries has been a principal factor in the development of tonnage cryogenic air separation plants. Accordingly, such air separation plants have been designed to produce high purity nitrogen, but a large portion of the separated nitrogen has been required to be used as a waste stream to remove the water and $CO_2$ both of which are frozen out of the feed air stream in the main reversing heat exchangers. Thus, only about 50% or less of the nitrogen contained in the feed air could be recovered as product nitrogen.

More recently, there has been an increasing demand for gaseous nitrogen in the chemical process industries wherein nitrogen is used in blanketing operations and other applications. Where the purity level requirements do not justify the cost of the ultrahigh purity nitrogen normally produced by the prior art cryogenic plants, non-cryogenic techniques for producing nitrogen have been used. Thus, nitrogen has been recovered from air by consuming the oxygen therein in a combustion chamber using natural gas, oil, or the like, as a fuel followed by further treatment to remove most of the carbon dioxide and water so as to produce a product nitrogen stream containing tolerable amounts of water and carbon dioxide. Although such combustion processes generally require a smaller capital investment than conventional cryogenic air separation plants, the operating costs of combustion processes have increased significantly because of the recently increased cost of the fuels required for the combustion step. At the same time, the need for nitrogen of higher purity than that offered by such combustion processes has also increased. As a result of these factors, a serious need has arisen for tonnage air separation plants which are capable of recovering larger volumes of high purity nitrogen at lower cost than conventional cryogenic plants.

SUMMARY OF THE INVENTION

It is therefore a principal object of the present invention to provide a method and apparatus for recovering substantially greater amounts of product nitrogen at a lower cost than that previously possible in cryogenic air separation plants.

It is a further object of the present invention to provide a method and apparatus for producing product nitrogen of substantially higher purity than that of the above-described combustion processes; i.e., above 98% nitrogen, at a cost equal to or lower than such combustion processes.

It is another object of the invention to provide a method and apparatus for producing one or more product oxygen streams with significant savings in the total power required.

These and other objects of the present invention are achieved by first passing the compressed feed air stream through heatless, pressure-swing adsorption driers to remove virtually all of the moisture before passing the pre-dried feed stream through reversing heat exchangers wherein the feed stream is cooled and the carbon dioxide is frozen out on the cold surfaces of the reversing heat exchanger passages. The treated feed air is then liquefied and separated in a distillation system so as to produce a large volume of high purity nitrogen. Most or all of the separated nitrogen is passed through the reversing passages of the heat exchanger to sublime the deposited carbon dioxide, and this nitrogen stream containing the desorbed carbon dioxide is recovered as a high purity product stream having a nitrogen purity such as 99% or greater. Since all of the separated nitrogen stream is not required to regenerate the reversing exchanger, an additional ultrahigh purity nitrogen stream may also be recovered having a purity in the order of 99.9% or greater.

The adsorption driers are regenerated by a relatively small volume of a purge gas stream which is withdrawn from the low pressure column and warmed in a non-reversing passage of the heat exchanger. In one mode of operation, this purge gas stream may constitute a portion of an oxygen-rich stream having an oxygen content in the order of 50% to virtually 100% oxygen, or it may be a nitrogen-rich stream comprising 50% to virtually 100% nitrogen depending upon where it is withdrawn from the column. In addition, high purity product oxygen may also be recovered, as well as, recovering the oxygen-rich purge as a product stream useful in certain applications.

In this manner, substantially greater amounts of product nitrogen can be recovered from the feed air at significantly lower power costs. For example, up to 90% of the nitrogen contained in the feed air can be recovered such that power savings in the order of 40% per unit volume of product nitrogen can be achieved with the present invention. Alternatively, where it is desired to maximize the production of high purity oxygen, the present invention enables power savings in the order of 20%.

DETAILED DESCRIPTION

Figure 1:
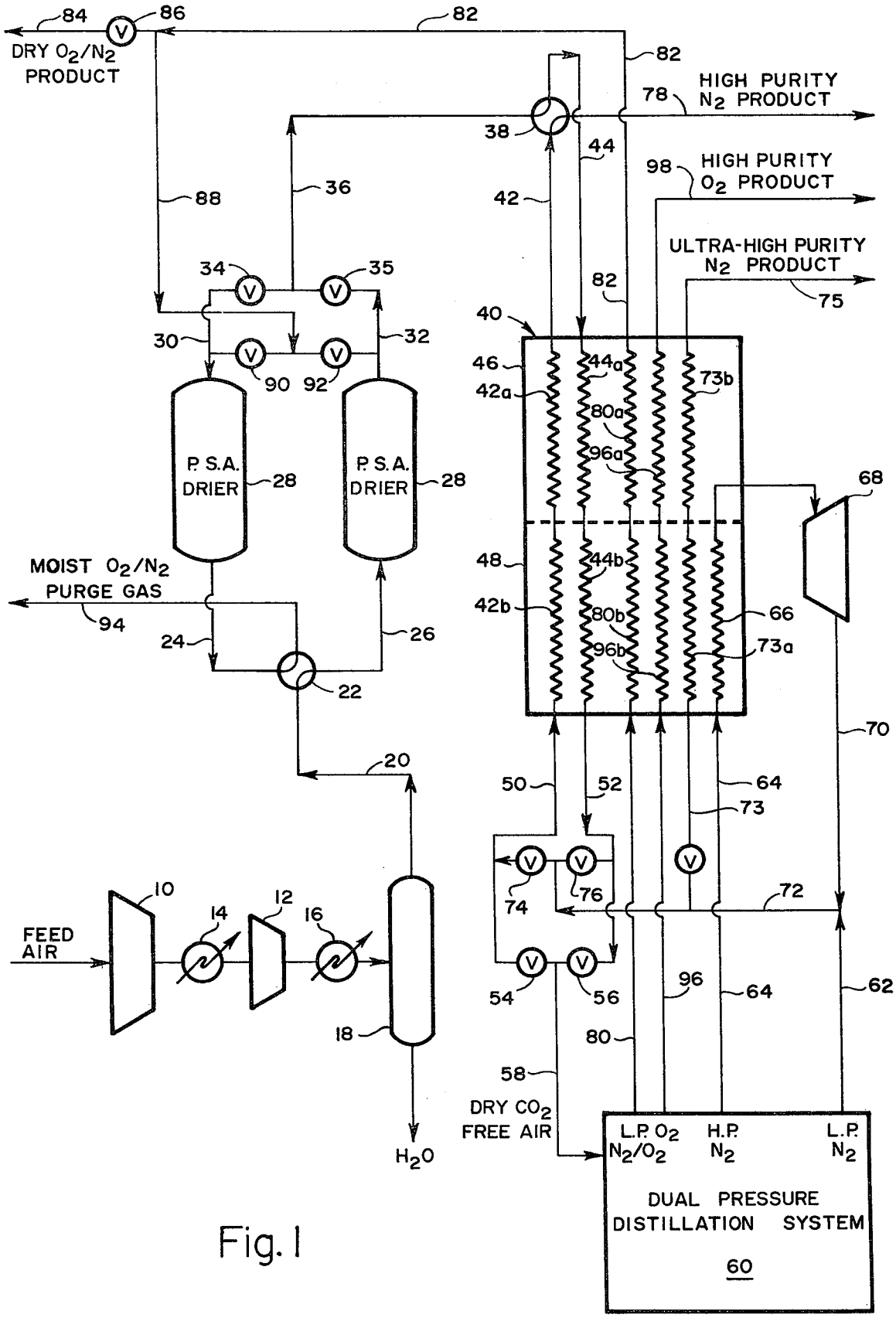
FIG. 1 is a simplified flowsheet illustrating the overall air separation cycle.

Referring to FIG. 1, the feed air stream is compressed in a multi-stage compressor schematically illustrated as comprising first and second stages 10 and 12 with a conventional interstage cooler 14 and after cooler 16. The compressed and cooled air, which may be at a pressure in the range of 100 to 150 psig, is then passed to a phase separator 18 wherein the condensed water is separated to effect a first lowering of the moisture content of the feed air stream. For example, 78 to 90 percent of the moisture initially contained in the feed air stream may be removed in water separator 18.

The compressed feed air stream then passes from water separator 18 through conduit 20 to a four-way valve 22 which alternately directs the feed air stream through lines 24 or 26 to one or other of driers 28. Driers 28 are of the adsorption type and, while they may be filled with any suitable moisture adsorbing material such as silica gel, molecular sieve or activated charcoal, activated alumina is preferred because of its resistance to degradation, high adsorptive capacity for water, relatively low cost, and relative ease of regeneration particularly at ambient temperatures such as, for example, in the order of 85°F. to 115°F.

Adsorbent driers 28 are of the so-called "heatless" type in which additional heat is not supplied to the drier to the purge stream regenerating the drier as is required in prior cryogenic air separation plants using adsorbers regenerated with heated air or nitrogen. Instead of requiring heating of the driers or the purge stream, a low pressure stream is used at an ambient temperature such that the driers are operated in the manner known in the art as pressure-swing adsorption. For example, the pressure of the low pressure purge gas stream is preferably in the order of 75 to 95 percent less than the compressed pressure of the feed air stream.

With the proper selection of the particular absorbent material, as well as the size of the adsorption vessels and the cycle time, the feed air stream is preferably dried to a dew point in the order of 0°F to −40°F which corresponds to a moisture content in the range of 160 to 10 ppm by volume of the feed air stream. Thus, virtually all of the moisture is removed from the feed air stream in the adsorption driers while they remain saturated with carbon dioxide such that essentially none of the carbon dioxide is removed in the driers.

The outlet conduits 30 and 32 of the adsorption driers are connected through check valves 34 and 35 to a conduit 36 through which the compressed and dried air is supplied to a four-way valve 38. Valve 38 operates to alternately pass the feed air stream through one or the other of reversing lines 42, 44 connected to a reversing heat exchanger 40. Reversing heat exchanger 40 may be of any conventional construction such as the well-known, core type exchanger having a plurality of plates and intermediate core passages as is well known in the heat exchanger art. While exchanger 40 may be of a single stage type, it is preferred that it be composed of multiple stages such as, for example, a first stage 46 and a second stage 48 having internal reversing passages **42*a*–44*a* and 42*b*–44*b*, respectively. Thus, the compressed feed air is cooled and the carbon dioxide is frozen out as ice on the internal surfaces of the reversing heat exchanger passages, along with the trace amount of residual water vapor. For example, the feed air may be cooled to a temperature in the order of −260°F to −270°F in reversing exchanger 40. The cooled air feed then passes through one or other of reversing conduits 50, 52 and check valves 54, 56 to a conduit 58 through which it passes to a dual pressure distillation system 60 the detailed operation of which will be subsequently described with particular reference to FIG. 2. In general, however, it is to be understood that the dual pressure distillation system 60** liquefies and separates the feed air stream by conventional cryogenic distillation techniques so as to produce at least one low pressure product nitrogen stream, and a low pressure purge stream of variable nitrogen/oxygen composition. In addition, a high pressure nitrogen stream may be withdrawn and expanded for refrigeration purposes, and a high purity oxygem stream may also be produced if desired.

As shown in FIG. 1, the low pressure nitrogen stream leaves the distillation system 60 through line 62, while a high pressure nitrogen stream leaves the distillation system through line 64. The high pressure nitrogen stream is warmed in a nonreversing passage 66 of exchanger 40 to a temperature in the range of −120°F to −240°F in countercurrent heat exchange with the feed air stream being cooled. The warmed high pressure nitrogen stream is then passed through an expander 68, which is preferably of the turbine type, in which it is expanded to a lower temperature to provide additional refrigeration by heat exchange with the feed air. The expanded low pressure nitrogen stream in line 70 is then joined with that in line 62, and the combined low pressure nitrogen streams are passed through line 72 and one or other of check valves 74, 76 and reversing lines 50, 52 through one or other of the reversing passages of heat exchanger 40. Alternatively, up to about 20% of the nitrogen in line 72 may be passed through line 73 and non-reversing passages **73*a*–73*b*, and be recovered as ultrahigh purity nitrogen through discharge line 75. Of course, this excess nitrogen which is not required to regenerate the reversing exchanger may be withdrawn from other than line 72, such as directly from the distillation column, or anywhere between the column and reversing exchanger 40.**

In passing through the reversing heat exchanger passages, the low pressure nitrogen stream is warmed to a temperature in the order of 85°F to 115°F and regenerates the heat exchanger passages by subliming the solid carbon dioxide, and the trace amount of residual water, which has been frozen out in the heat exchanger passages. Thereafter, this product nitrogen stream, at a pressure in the order of 2–20 psig, passes through four-way valve 38 and is discharged as a high purity product stream through line 78 having a nitrogen purity of substantially above 98% such as 99.5%, and even above 99.9% of nitrogen. Due to the virtually complete removal of the water in driers 28, the trace amount of residual water which is deposited in the reversing passages of the heat exchanger 40 may be in the order of 230 to 14 ppm (by volume); i.e., 0.023% to 0.0014% of the product nitrogen stream. The carbon dioxide which is sublimed from the reversing heat exchanger passages by the product nitrogen stream may be in the order of 350 to 650 ppm (by volume); i.e., 0.035% to 0.065% of the product nitrogen stream. Due to the high degree of nitrogen-oxygen separation which may be effected in the distillation system 60, the oxygen content of the product nitrogem stream may be as low as 50 ppm (0.005%). Alternatively, it may be as high as 1,000 ppm (0.1%), but is preferably maintained in the order of 100 to 500 ppm (0.01% to 0.05%) of the product nitrogen stream. Thus, by using pre-driers 28 for water removal and by regenerating the reversing exchangers with the product nitrogen stream, virtually all of the nitrogen contained in the feed air stream may be recovered as high purity product nitrogen, as opposed to, conventional nitrogen plant cycles in which approximately 50% of the available nitrogen and 100% of the available oxygen is required to remove both the water and carbon dioxide from the reversing exchanger such that the resulting high moisture content makes it unusable as product nitrogen and it must be wasted.

The low pressure purge stream is discharged from the distillation system 60 through line 80 and is passed through non-reversing heat exchanger passages **80*b* and 80*a* of heat exchanger 40 in which it is warmed to a temperature in the range of 85°F to 115°F in countercurrent heat exchange with the feed air stream. The warm and extremely dry purge stream is discharged from exchanger 40 through conduit 82 and, since the volume of this stream may be greater than that required to regenerate the driers, a portion may be withdrawn as a dry product stream through line 84 having a flow control valve 86. The remainder of this low pressure stream is passed through line 88 and one or other of check valves 90, 92 to regenerate the adsorption drier which is in its regeneration cycle. Because this stream is at a low pressure such as 5 to 40 psig, or preferably in the order of 10 to 30 psig, and is virtually "bone-dry", this stream performs as an excellent purge gas for removing the moisture from the adsorption driers by the pressure-swing technique. Thereafter, this purge stream leaves the driers through one or other of lines 24, 26 and is discharged from the system through four-way valve 22 and discharge conduit 94.**

After regenerating the drier, this purge stream will have a water content in the order of 1.5 to 4.5% by volume which prevents its use in those applications where the moisture content would be detrimental. However, if this purge stream is rich in oxygen, due to the particular mode of operation of the distillation system as will be described subsequently, this purge stream may be used in various applications including, for example, as the aeration feed gas for oxygenated activated sludge wastewater treatment plants such as disclosed in U.S. Pat. No. 3,725,258 in which high purity oxygen is not required and the moisture content is not detrimental. In addition, there are other applications for this moist oxygen-rich stream such as in the oxygen enrichment of certain combustion processes.

While the present invention is in no way limited to the use of any particular design of a dual pressure distillation system, one such system will now be described with reference to FIG. 2 wherein numeral 100 indicates an integral dual pressure distillation column having a high pressure column 102 and a low pressure column 104 separated by a reflux-condenser 106. Of course, physically separated high and low pressure columns may be employed if desired. The cooled air feed stream enters the high pressure column 102 through line 58 and it is rectified by a downwardly flowing reflux stream so as to produce crude liquid oxygen at the bottom of the high pressure column, and high purity gaseous nitrogen in the upper portion of the high pressure column. This high purity nitrogen, which may have a purity of 99.9% or greater, is withdrawn from the upper portion of high pressure column 102 through line 108. A first portion may be passed through line 109 and warmed in a multi-stage exchanger 110 from which it is discharged through line 64 as the high pressure nitrogen stream previously described. A second portion of the nitrogen withdrawn from the high pressure column through line 108 is passed through line 112 into the reflux condenser 106 which liquefies this portion of the nitrogen. A first portion of the liquefied nitrogen is provided as reflux for the high pressure column 102 through line 114, while a second portion of the liquid nitrogen is passed through line 116 to subcooler 118. The subcooled liquid nitrogen is passed through line 120 and expansion valve 122 into the upper portion of the low pressure column 104 as reflux for the low pressure column. If desired, a small amount of this liquid nitrogen may be withdrawn as product liquid nitrogen through line 124 having control valve 126. Of course, reflux-condenser 106 may be of any conventional design including those having internal passages in direct communication with high pressure column 102 such that separate lines 112 and 114 are not required.

Nitrogen gas at low pressure and having a purity of 99.9% or greater is withdrawn from the top of the low pressure column 104 through line 128. After being warmed in subcooler 118, this high purity stream is passed through line 129 to exchanger 110 wherein it is further warmed and discharged through line 62 as the previously described low pressure product nitrogen stream.

As previously indicated, the composition of the low pressure stream to be used for regenerating the adsorption driers may vary widely depending upon the vertical point from which it is withdrawn from the low pressure column. In turn, this is dependent upon whether it is desired to maximize the volume of product nitrogen or the volume of product oxygen.

Assuming that it is desired to maximize the volume of nitrogen, the low pressure purge stream is withdrawn through a line 130 which may be vertically positioned such that the oxygen-nitrogen mixture in the column has an oxygen concentration in the order of 50% to 95% oxygen by volume, and more preferably in the order of 70% to 90% oxygen by volume. This oxygen-rich stream is passed through line 130 and warmed in exchanger 110 from which it is discharged through line 80 as the previously recited low pressure purge stream. However, since for each 100 moles of feed air only about 17 moles of purge gas are required to regenerate the driers, and about 70 moles are produced as the high purity product nitrogen, the feed air contains an excess of about 13 moles which may be withdrawn from the column through line 130 and passed through exchanger 110, line 80, exchanger 40 and line 82, but then be discharged as dry oxygen-rich product gas through line 84. Alternatively, if the low pressure column is designed with additional trays below the level of line 130, as shown in the illustrated embodiment of FIG. 2, then the excess 13 moles may be further rectified so as to produce high purity product oxygen having an oxygen purity of 99.5% or greater. This high purity oxygen stream may then be withdrawn through line 131 and, while some or all of it could be passed through by-pass line 135 to increase the oxygen content of the purge gas in line 130 to 95% or greater, it is preferably passed through line 131, exchanger 110, line 96, exchanger 40 and is discharged through line 98 as dry, high purity product oxygen. Of course, depending upon the number of trays and/or by suitable regulation of flow control valves 130′, 131′ and 135′, the relative volumes of the oxygen-rich and high purity oxygen streams may be varied as desired such that the oxygen-rich purge gas may comprise anywhere from 50% oxygen to essentially pure oxygen.

On the other hand, where it is desired to maximize the recovery of the 21% of oxygen available in the feed air, the low pressure purge stream may be withdrawn from the column at a higher point at which it contains more nitrogen and less oxygen, including for example, a portion of the stream of high purity nitrogen withdrawn through line 128 from the top of the column. Therefore, for purposes of example, a line 133 is shown in FIG. 2 near to the top of the low pressure column through which a nitrogen-rich low pressure purge stream may be withdrawn from the column and passed to line 130 through which it may be passed as the low pressure drier purge stream previously described. In addition, it will be apparent that by suitable adjustment of the flow control valves 133′ and 130′ in lines 133 and 130, the low pressure purge stream for regenerating the driers may have any percentages of oxygen and nitrogen which are desired to satisfy the particular object of a specific plant with respect to producing the desired volumes of product nitrogen and product oxygen. Thus, the composition of the purge gas may comprise any ratio of oxygen to nitrogen between essentially 100% oxygen to essentially 100% nitrogen.

Figure 2:
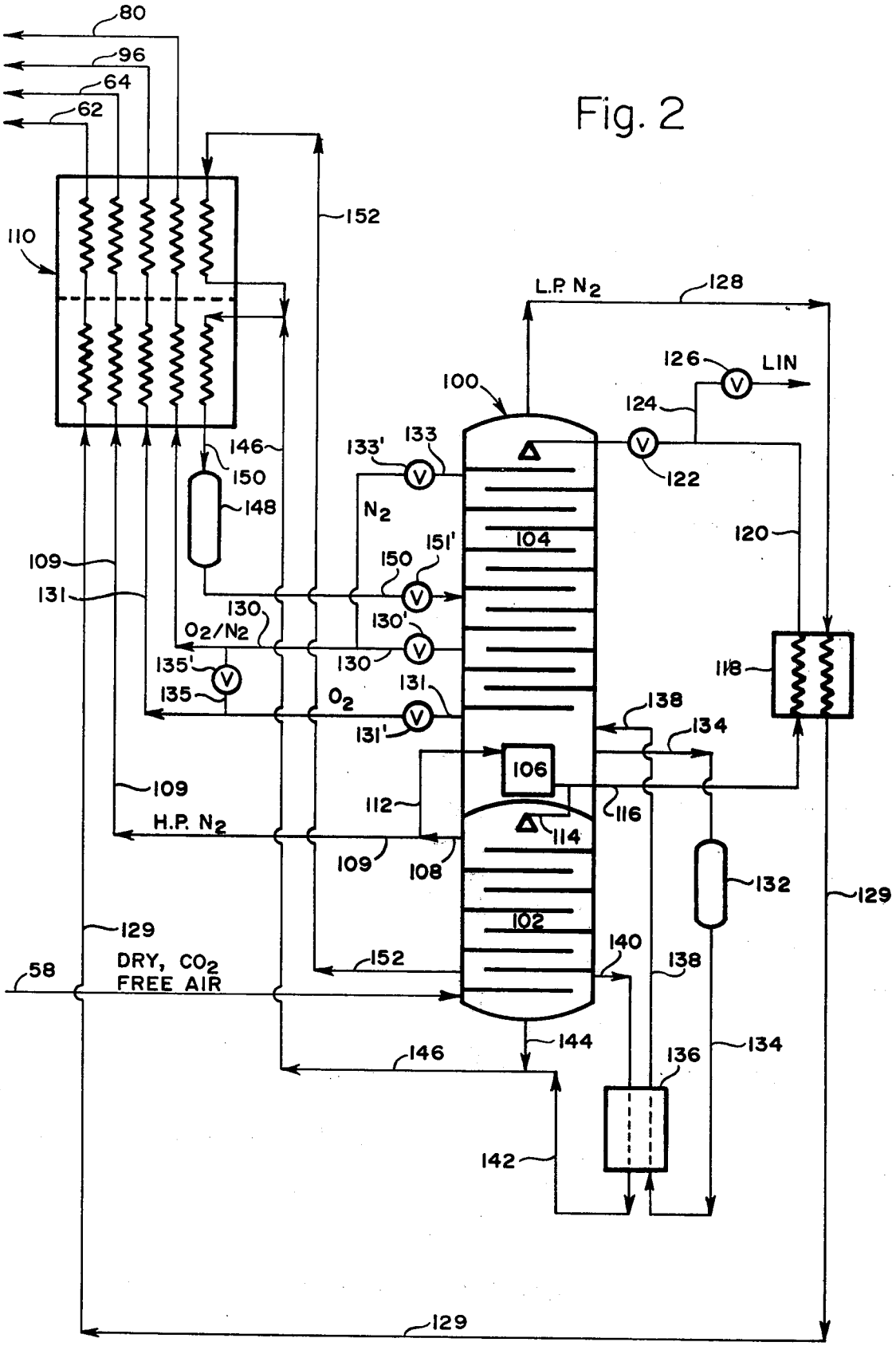
FIG. 2 is a simplified flowsheet illustrating one example of a distillation system which may be used in the overall cycle of FIG. 1.

As further shown in FIG. 2, the distillation system includes a conventional hydrocarbon absorber 132 through which some liquid oxygen withdrawn from the low pressure column is passed to prevent the buildup of explosive hydrocarbons. This stream is then passed through line 134 and warmed in exchanger 136 before being returned to the low pressure column through line 138.

In the particular dual pressure distillation column illustrated in FIG. 2, the feed air stream in line 58 is not passed through exchanger 110 such that it enters the column in a cold, gaseous state. Accordingly, refrigeration is required to liquefy the feed stream in the column and this refrigeration is provided by withdrawing a portion of the column fluid from the lower portion of the high pressure column 102 through line 140 and liquefying it in heat exchange from the withdrawn liquid oxygen in exchanger 136. From exchanger 136 the withdrawn column fluid passes through line 142 and is combined with crude liquid oxygen discharged from the bottom of the column through line 144. This combined stream is passed through line 146 to the second stage of exchanger 110 wherein it is subcooled and discharged through hydrocarbon adsorber 148 and expansion valve 150' as liquefied feed to the low pressure column 104. A second portion of fluid is withdrawn from the lower portion of the high pressure column 102 through line 152 and is passed through the first stage of heat exchanger 110 after which it is combined with the stream in line 146 which, as just described, is further cooled and expanded to provide a liquefied feed for the low pressure column.

While a dual pressure distillation column is preferred in the distillation system for the present invention, numerous variations are known in such dual pressure column cycles. For example, where the feed air stream is partially liquefied prior to being introduced into the high pressure column, as for example by passage through exchanger 110, the withdrawal of column fluid through line 152 and the liquefaction thereof in exchanger 110 is not required. Thus, the present invention may be employed with any dual pressure distillation system which is capable of producing at least one product nitrogen stream, as well as, at least one low pressure purge stream for regenerating the pressure-swing driers.

From the foregoing description of one preferred embodiment of the invention it will be apparent that the provision of heatless, pressure-swing adsorption driers for removing the moisture content of the feed air separately from the carbon dioxide removal which is performed in the reversing passages of the heat exchanger, which are regenerated by an outgoing nitrogen product stream, provides for the production of almost twice as much moisture-free product nitrogen than is possible with previous cycles wherein almost half of the separated nitrogen is required to remove both the moisture and the carbon dioxide from the reversing heat exchangers. Thus, 90% or more of the nitrogen contained in the feed air may be recovered as product nitrogen, while at the same time, providing several alternatives for producing oxygen-rich and/or high purity oxygen product streams. In addition, where the purge gas stream for regenerating the driers comprises an oxygen-rich stream, even this moist oxygen stream may be used in those applications in which the moisture content is not detrimental. Stated otherwise, even if the oxygen-rich stream or streams are wasted, the present invention provides for the production of the same volume of product nitrogen gas at a power savings in the order of 40% over previous cryogenic air separation cycles and, when operated to maximize oxygen recovery, savings of total required energy in the order of 20% may be achieved over conventional cycles wherein substantial energy is required to desorb conventional adsorbers by heated gases.

Of course, numerous variations in the details of the illustrated embodiment will be apparent to those skilled in the art. For example, the four-way valves and/or the sets of check valves may be replaced by other types of positive action valves well known in the art. Thus, any type of switch valves may be used, and reversing exchanger 40 may be in the form of one or more single or multiple-stage exchangers of any conventional design. Therefore, it is to be understood that the foregoing description is intended to be purely illustrative of the principles of the invention, and that the true scope of the invention is not to be limited other than as expressly set forth in the following claims.

We claim:

1. A cryogenic air separation process for increasing the recovery of gaseous product nitrogen from an air feed stream comprising the steps of:

a. drying a compressed feed air stream by passing said feed stream through a pressure-swing adsorption drier, b. cooling said dried feed air stream and removing carbon dioxide from said dried feed air stream by passing said dried feed air stream through a reversing passage of a heat exchanger in countercurrent heat exchange with at least one product stream colder than said feed air stream, c. separating said cooled feed air stream in a dual pressure distillation system including high and low pressure distillation columns to produce at least one low pressure product nitrogen stream, and at least one other low pressure stream, d. passing at least a portion of said other low pressure stream through said pressure-swing adsorption drier so as to regenerate said adsorption drier at a pressure lower than that of said compressed feed air stream, e. passing at least a portion of said product nitrogen stream through said reversing heat exchanger passage so as to regenerate said reversing heat exchanger passage by subliming said removed carbon dioxide, and f. recovering said nitrogen stream after passage through said reversing heat exchanger passage as a product nitrogen stream having a nitrogen purity of at least 99.5%.

2. The air separation process as claimed in claim 1 in which said other low pressure stream is withdrawn from a portion of the low pressure distillation column such that said other low pressure stream comprises an oxygen-rich stream.

3. The air separation process as claimed in claim 2 in which said oxygen-rich stream is separated such as to have a volume greater than that required to regenerate said adsorption drier, and withdrawing a portion of said oxygen-rich stream as a dry oxygen-rich product stream before passing the remaining portion through said adsorption drier to regenerate said drier.

4. The air separation process as claimed in claim 3 further including the step of recovering said oxygen-rich stream after passage through said adsorption drier as a moist oxygen-rich product stream.

5. The process as claimed in claim 4 including the step of feeding said moist oxygen-rich product stream to a wastewater treatment plant as oxygen-rich aeration gas.

6. The air separation process as claimed in claim 1 in which said other low pressure stream is withdrawn from a portion of the low pressure distillation column such that said other low pressure stream comprises a nitrogen-rich stream.

7. The air separation process as claimed in claim 1 further including the step of separating said cooled feed air stream in said dual pressure distillation system to produce an additional stream having an oxygen content greater than said other low pressure stream, warming said additional stream by passage in countercurrent heat exchange with said feed air stream, and recovering said additional stream as a product oxygen stream.

8. The cryogenic air separation process as claimed in claim 1 in which step (c) comprises the separation of said other low pressure stream having a volume greater than that required to regenerate said adsorption drier, and withdrawing a portion of said other low pressure stream as a dry product stream before passing the remaining portion through said adsorption drier to regenerate said drier.

9. A cryogenic air separation system comprising compressor means for compressing a feed air stream, a plurality of pressure swing adsorption driers connected through switch valve means to alternately receive said compressed feed air stream and remove the moisture contained in said feed air stream, a reversing heat exchanger having at least two reversing passages connected through switch valve means to cool said dried feed air stream and freeze out the carbon dioxide contained in said dried feed air stream, dual pressure distillation means connected to receive said cooled air stream and separate said air stream into at least one low pressure nitrogen stream having a nitrogen purity above 98% and at least one other low pressure stream, switch valve means for alternately passing at least a portion of said nitrogen stream through said reversing heat exchanger passages countercurrent to said feed air stream to cool said feed air stream and sublime the carbon dioxide from said reversing passages, means for withdrawing said nitrogen stream containing said sublimed carbon dioxide from said reversing exchanger passages as a product nitrogen stream, means for passing said other low pressure stream through non-reversing heat exchanger passage means to cool said feed air stream and warm said other low pressure stream, and switch valve means for alternately passing at least a portion of said other low pressure stream through said adsorption driers to remove the moisture from said driers.

10. The cryogenic air separation system as claimed in claim 9 in which said adsorption driers comprise pressure-swing adsorbers containing an adsorbent capable of being regenerated at ambient temperatures.

11. The cryogenic air separation system as claimed in claim 9 wherein said dual pressure distillation means include a low pressure distillation column having a sufficient number of trays for producing said other low pressure stream with an oxygen content of at least 50% oxygen by volume, and sufficient additional trays to produce a second oxygen stream having an oxygen content of at least 99.5% oxygen by volume.

12. A cryogenic air separation system comprising:

a. pressure-swing adsorption means for removing moisture from a compressed air stream, b. reversing heat exchanger means for cooling said dried air stream and freezing out $CO_2$ from said dried feed air stream, c. cryogenic distillation means for separating said cooled air stream into at least one low pressure nitrogen product stream and an additional low pressure stream, d. passage means for passing at least a portion of said additional low pressure stream through said pressure-swing adsorption means for removing moisture adsorbed in said adsorption means at a pressure less than the pressure of said compressed air stream, e. passage means for passing at least a portion of said nitrogen product stream through said reversing heat exchanger means for removing said frozen $CO_2$ from said reversing heat exchanger means, and f. passage means for withdrawing said nitrogen product stream from said reversing heat exchanger means as a product stream comprising at least 99.5% nitrogen.

* * * * *